US010143914B2

(12) United States Patent
Stowers

(10) Patent No.: US 10,143,914 B2
(45) Date of Patent: Dec. 4, 2018

(54) PUZZLE GAME AND METHOD OF USE

(71) Applicant: Donald E. Stowers, Kansas City, MO (US)

(72) Inventor: Donald E. Stowers, Kansas City, MO (US)

( * ) Notice: Subject to any disclaimer, the term of this patent is extended or adjusted under 35 U.S.C. 154(b) by 0 days.

(21) Appl. No.: 15/789,800

(22) Filed: Oct. 20, 2017

(65) Prior Publication Data

US 2018/0111043 A1 Apr. 26, 2018

Related U.S. Application Data

(60) Provisional application No. 62/410,441, filed on Oct. 20, 2016.

(51) Int. Cl.
*A63F 9/08* (2006.01)
*A63F 9/06* (2006.01)

(52) U.S. Cl.
CPC ..... *A63F 9/0857* (2013.01); *A63F 9/0604* (2013.01); *A63F 9/0838* (2013.01)

(58) Field of Classification Search
CPC .... A63F 9/0857; A63F 9/0604; A63F 9/0826; A63F 9/0838
See application file for complete search history.

(56) References Cited

U.S. PATENT DOCUMENTS 4,540,177 A * 9/1985 Horvath ..... A63F 9/0834 273/153 S
4,593,907 A * 6/1986 Abu-Shumays ..... A63F 9/0834 273/153 S
4,667,961 A * 5/1987 Abu-Shumays ..... A63F 9/0834 273/153 S
5,566,941 A * 10/1996 Destics ..... A63F 9/0857 273/153 S
5,826,871 A * 10/1998 Li ..... A63F 9/0834 273/153 S
5,836,584 A * 11/1998 Chen ..... A63F 9/0857 273/153 S
5,992,850 A * 11/1999 Li ..... A63F 9/0826 273/153 S
6,237,914 B1 * 5/2001 Saltanov ..... A63F 9/12 273/156
6,857,632 B2 * 2/2005 Tanner ..... A63F 9/0857 273/153 S
7,823,884 B2 11/2010 Canter
8,109,515 B2 2/2012 Fedoseyev et al.
D660,919 S * 5/2012 Perrin ..... D21/478
2009/0127783 A1 * 5/2009 Paquette ..... A63F 9/0834 273/153 S

* cited by examiner

*Primary Examiner* — Steven Wong

(74) *Attorney, Agent, or Firm* — Law Office of Mark Brown, LLC; Christopher M. DeBacker

(57) ABSTRACT

A hand-held puzzle game having an outer cube-shaped puzzle surrounding an inner spherical puzzle. An embodiment of the invention provides a six-sided, two-by-two cube puzzle containing a spherical puzzle with nine floating two-color parts and six pole centers, three of which are V-shaped to restrict rotation in some directions. The outer cube and inner sphere puzzles maybe solved independently, or the two puzzles may be solved jointly to solve the entire puzzle.

11 Claims, 18 Drawing Sheets

PUZZLE GAME AND METHOD OF USE

CROSS-REFERENCE TO RELATED APPLICATION

This application claims priority in U.S. Provisional Patent Application No. 62/410,441, filed Oct. 20, 2016, which is incorporated herein by reference.

BACKGROUND OF THE INVENTION

1. Field of the Invention

The present invention relates generally to a puzzle game and method for use thereof, and more specifically to a four-dimensional hand-held puzzle game.

2. Description of the Related Art

Existing puzzle games are limited to a single puzzle element to be solved, such as the common Rubik's cube puzzle and related cubic and spherical puzzles. These puzzles are common and solutions are readily available. What is needed is a puzzle with an additional dimension of complexity.

Heretofore there has not been available a system or method for a puzzle game with the advantages and features of the present invention.

BRIEF SUMMARY OF THE INVENTION

The present invention generally provides a hand-held puzzle game having an outer cube-shaped puzzle surrounding an inner spherical puzzle. An embodiment of the invention provides a six-sided, two-by-two cube puzzle containing a spherical puzzle with nine floating two-color parts and six pole centers. The outer cube and inner sphere puzzles maybe solved independently, or the two puzzles may be solved jointly to solve the entire puzzle.

Only the outer cube pieces are moved with direct contact. The inner sphere is never directly manipulated, but instead is moved by moving the outer cube pieces.

The cube contains an inner sphere in which some of the pieces are fused to their respective poles, creating asymmetrical movements. One outer corner cube is locked in place for the three adjacent poles, completely changing the algorithms required to solve the puzzle as compared to other puzzles.

The outer cube puzzle is solved by positioning the panels such that every panel on a single side of the cube is the same color. Similarly, the inner sphere is solved by matching the six center poles with the color of the half of the two-color floating part they touch creating a solid color dome on each of the six sides.

To solve the entire puzzle, both the cube puzzle and the sphere puzzle must be solved at the same time. The colors of these locations will match up: the center pole of the inner sphere; the four floating parts of the inner sphere where they contact the center pole; and the four facing sides of the outer cube or 2 V-shaped poles; ending in a dome shape.

The outer cubes rotate about the poles of the inner sphere, thereby rotating both the outer cube panels and the inner sphere floating elements.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning. Panels may refer to an aspect of facet of the element, including but not limited to color, texture, image, or shape.

II. Preferred Embodiment Puzzle Game 2

Figure 1:
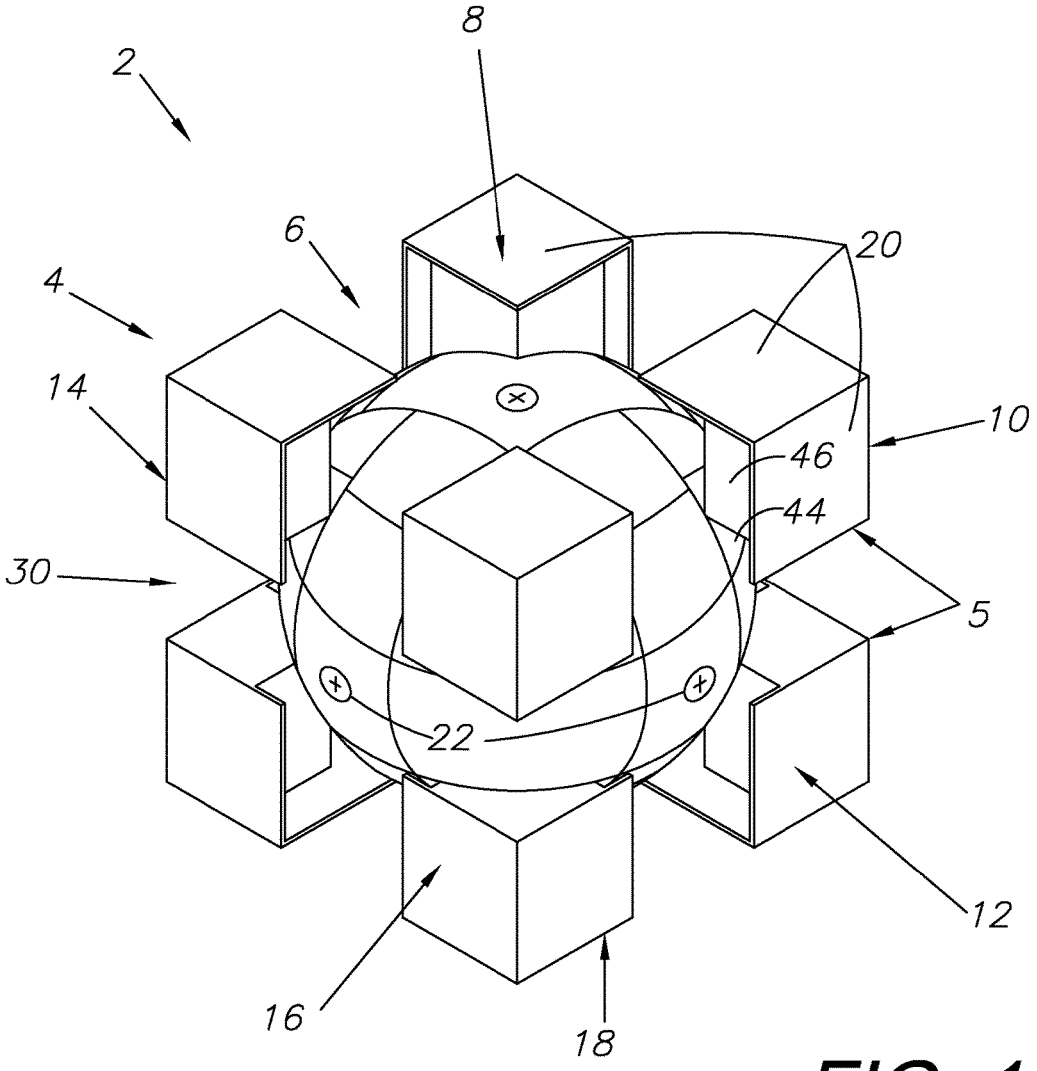
FIG. 1 is a three-dimensional isometric view of a preferred embodiment of the present invention.
Figure 2:
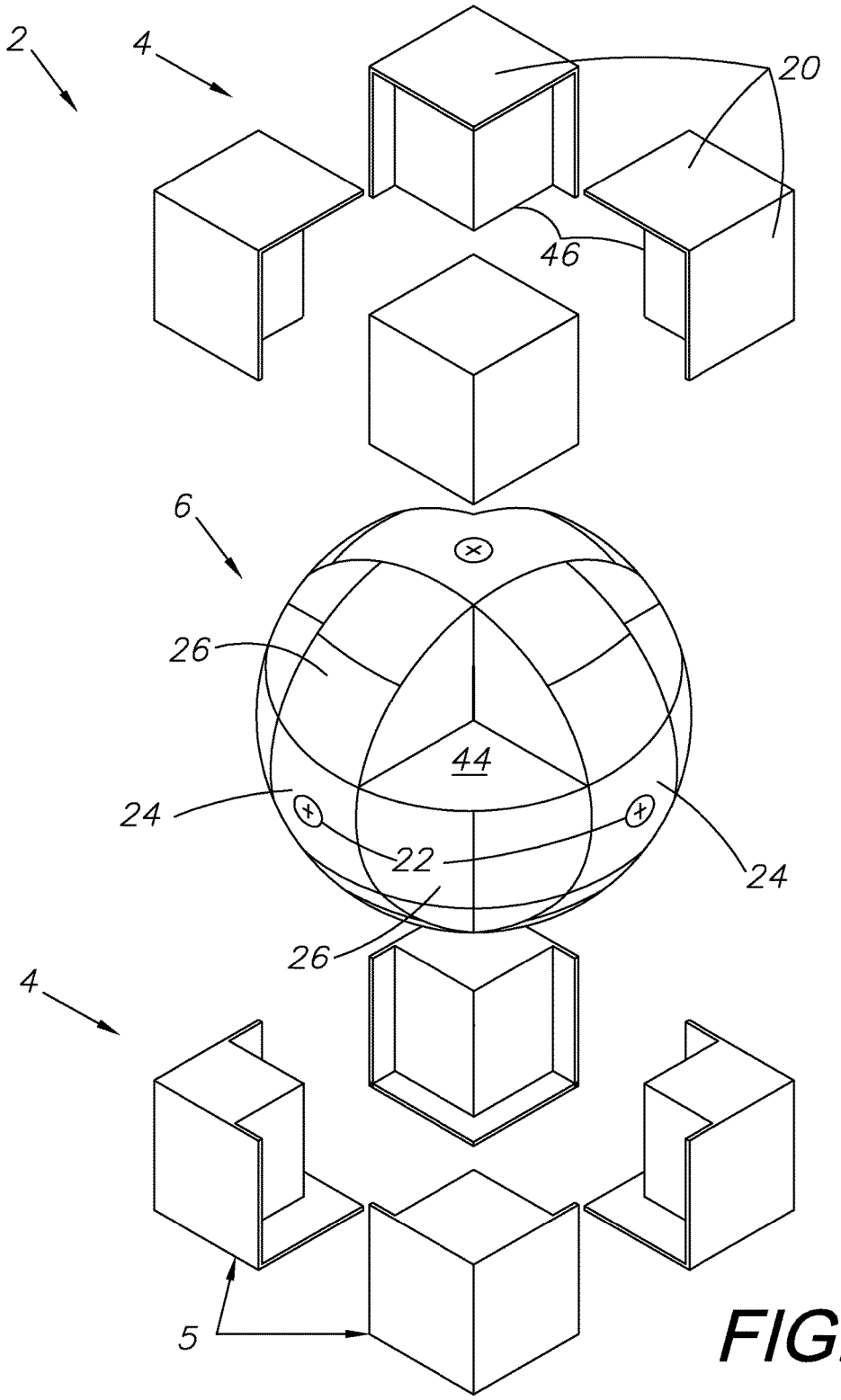
FIG. 2 is an exploded three-dimensional isometric view thereof.
Figure 3:
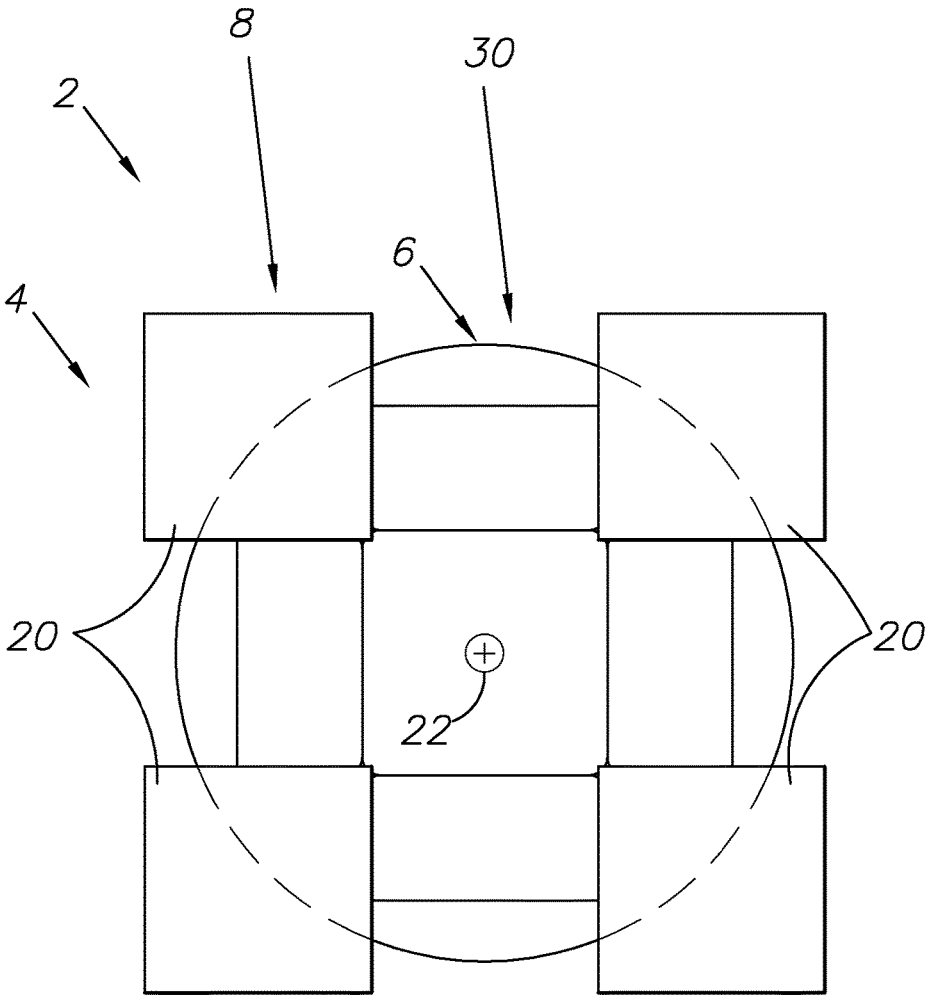
FIG. 3 is a top plan view of the preferred embodiment thereof.
Figure 4:
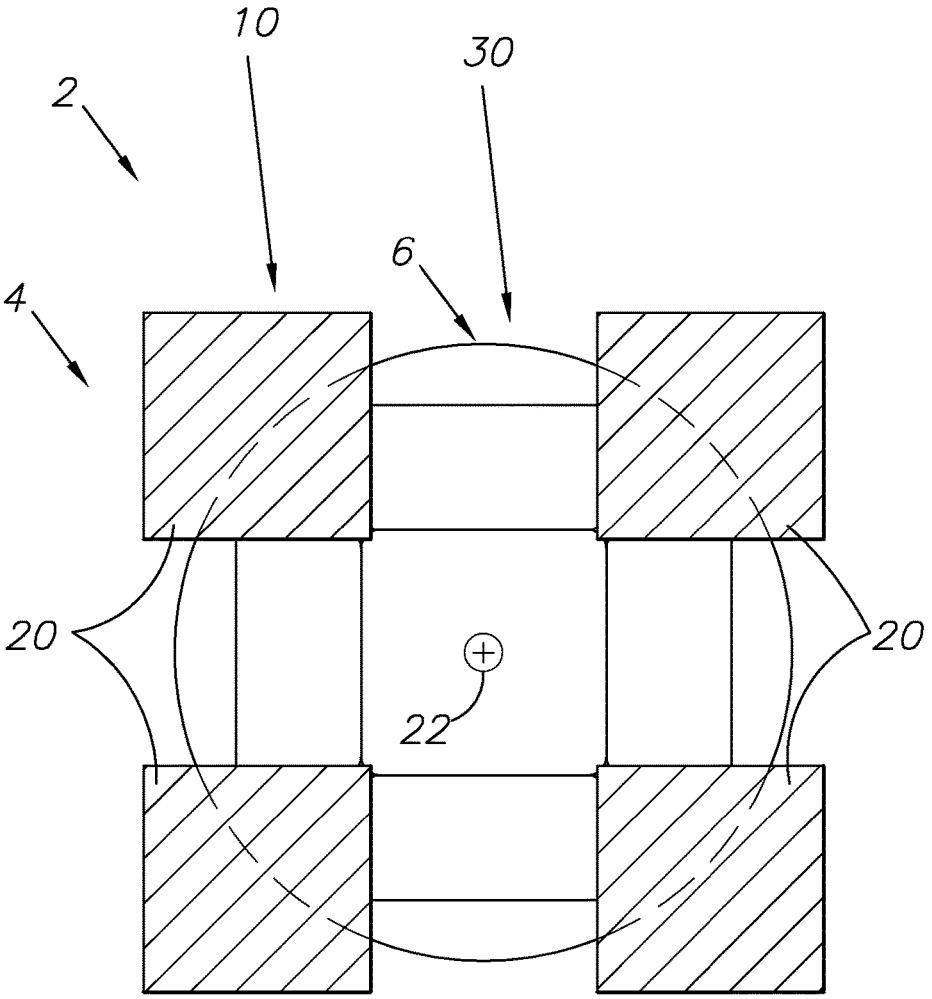
FIG. 4 is a rear side elevational view thereof.
Figure 5:
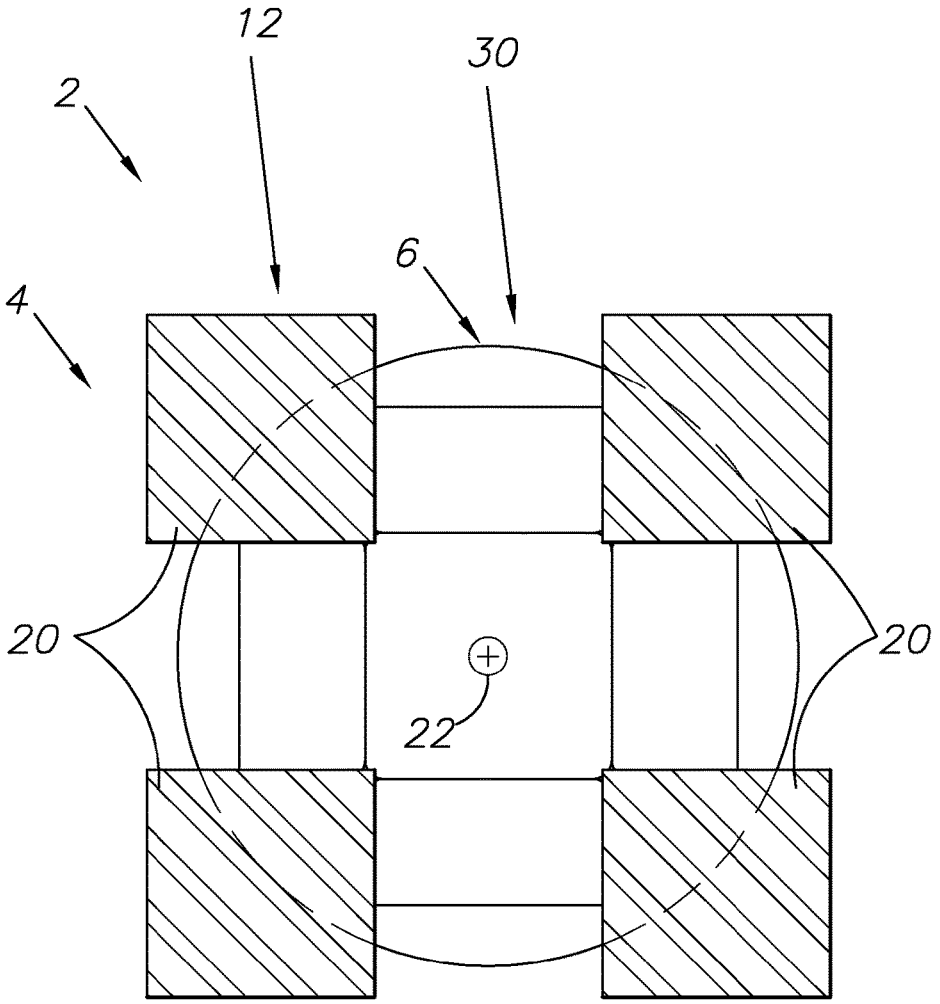
FIG. 5 is a bottom plan view thereof.
Figure 6:
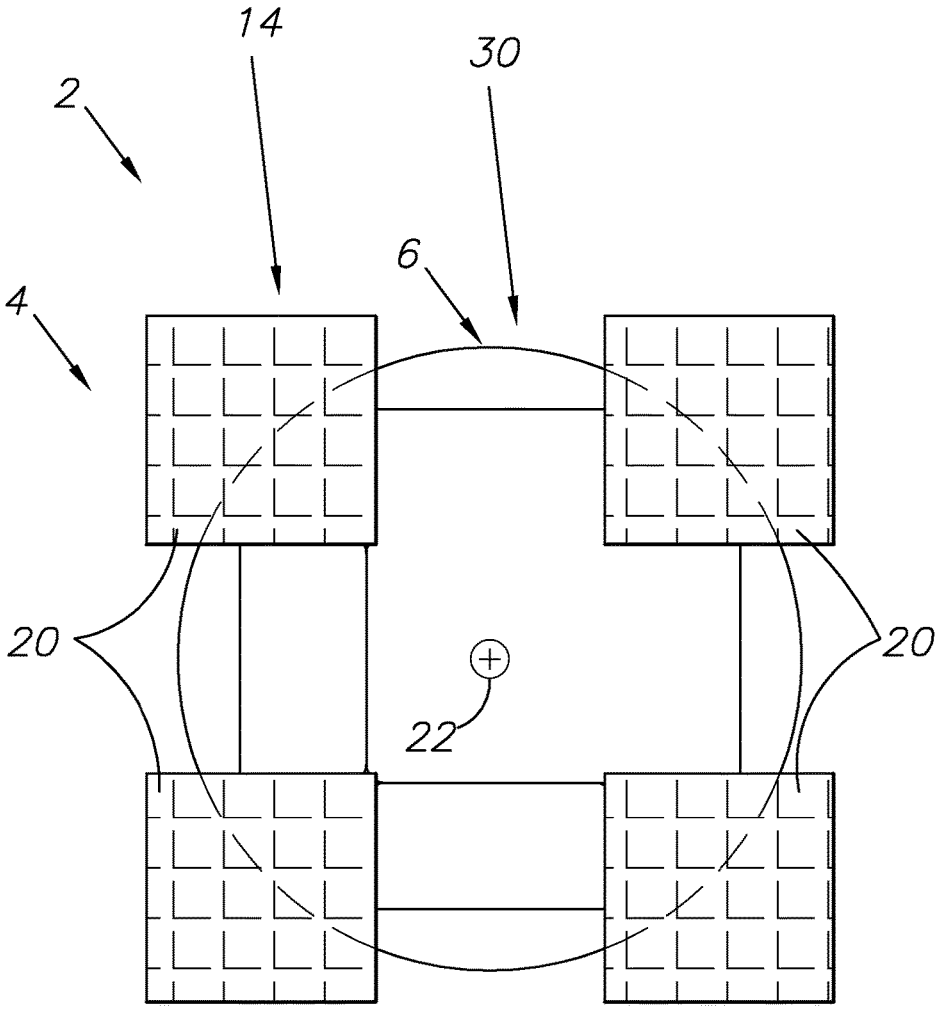
FIG. 6 is a right side plan view thereof.
Figure 7:
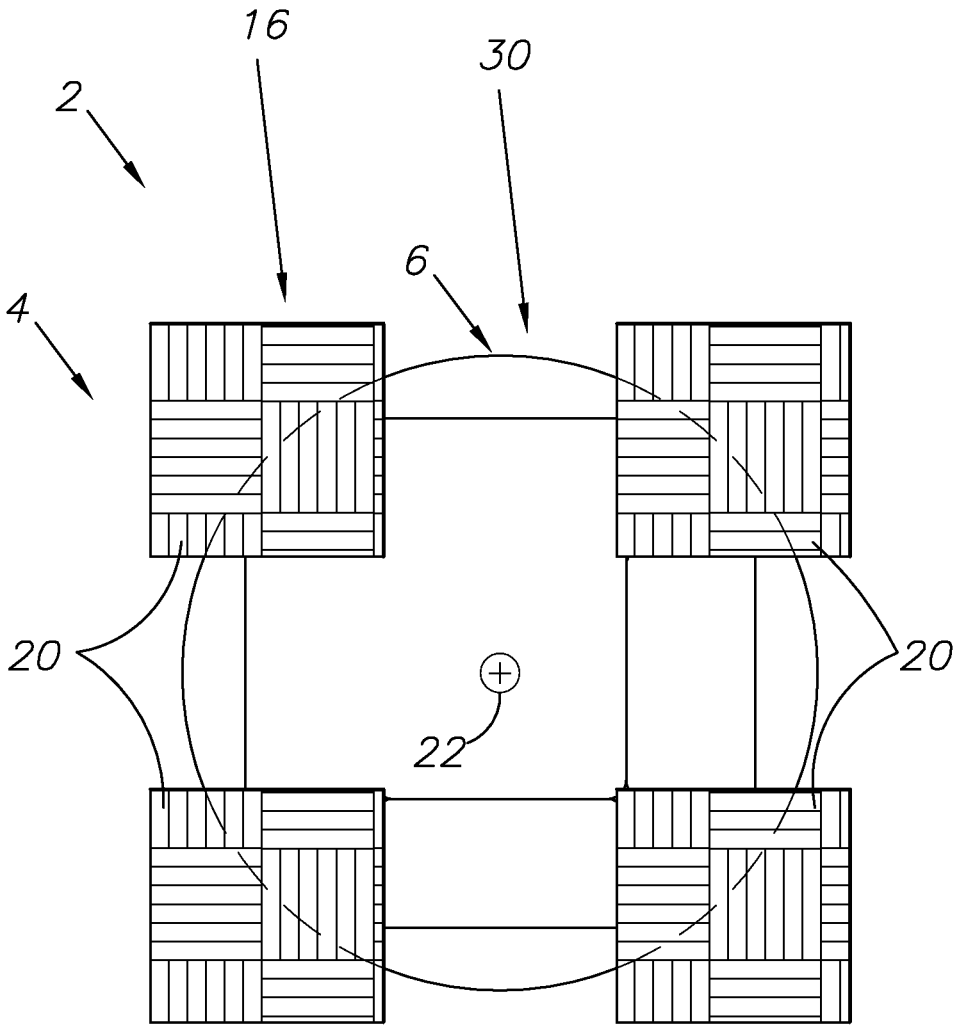
FIG. 7 is a front side elevational view thereof.
Figure 8:
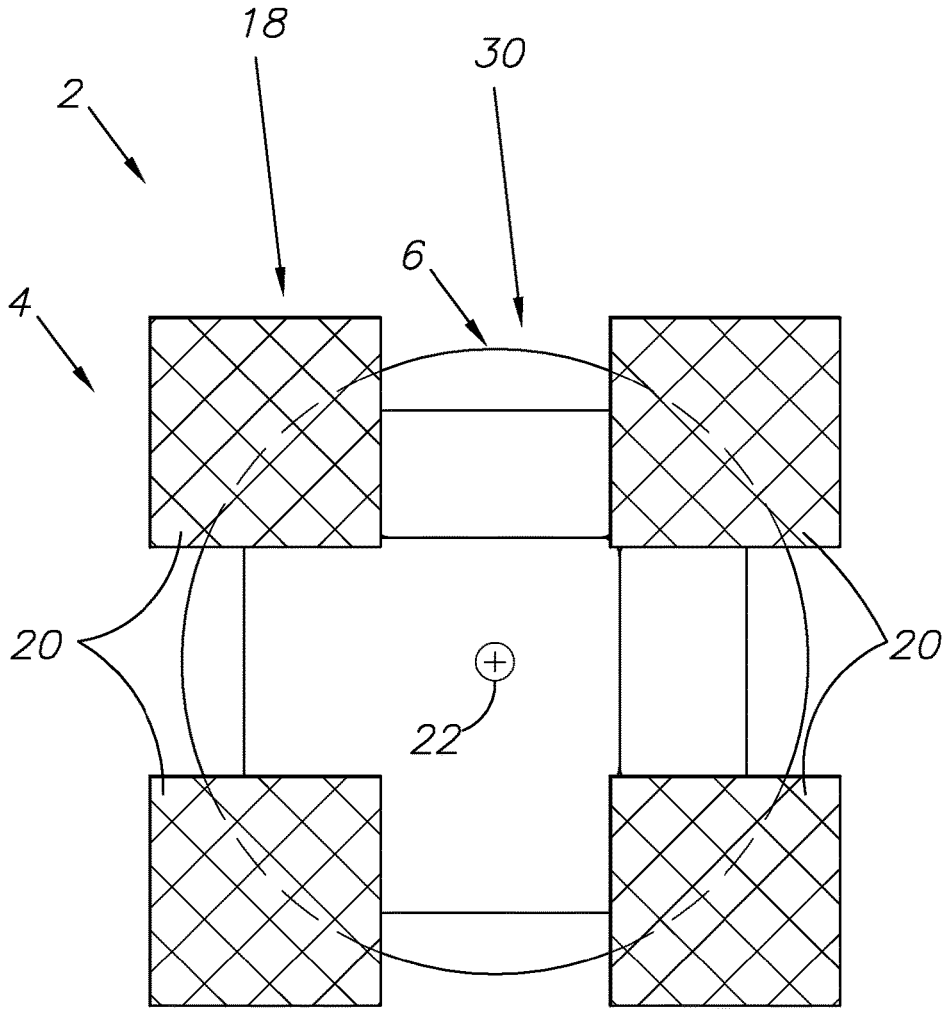
FIG. 8 is a left side elevational view thereof.
Figure 9:
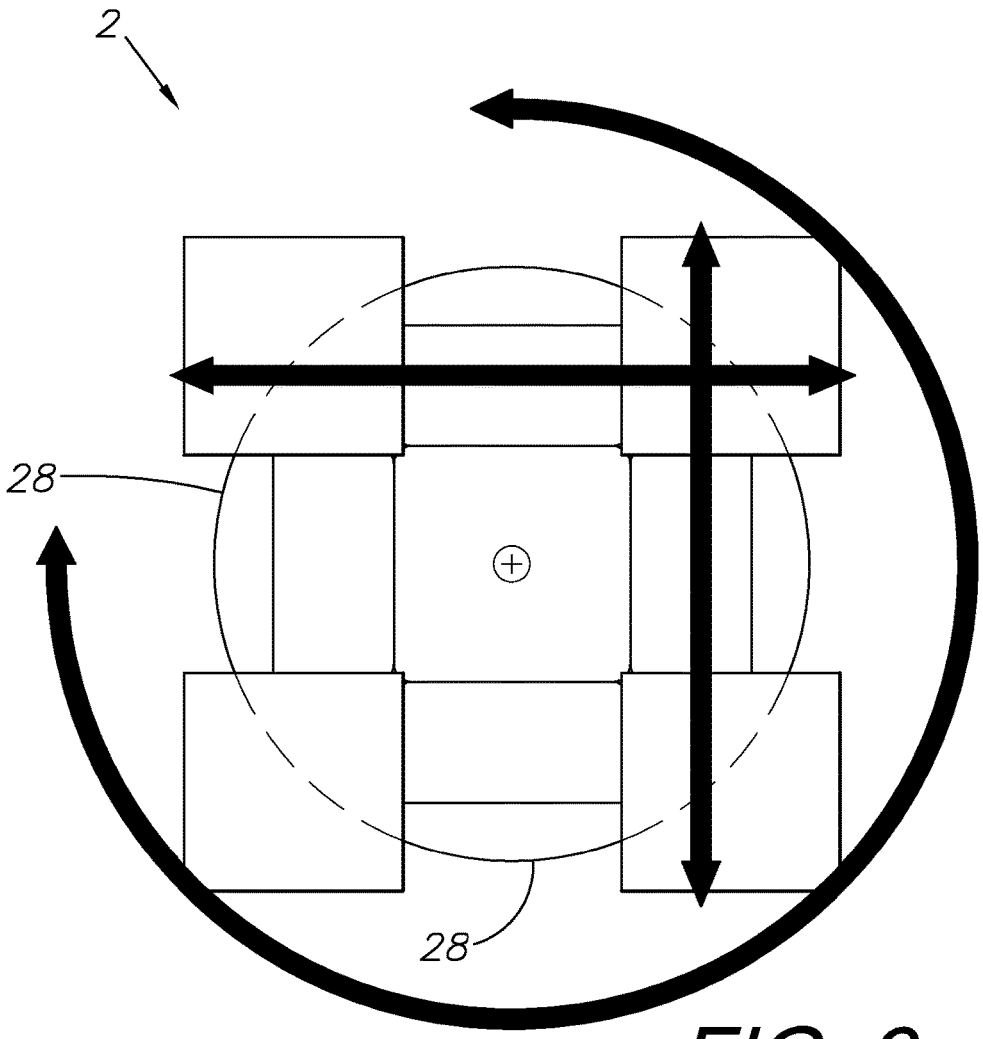
FIG. 9 is the top plan view of FIG. 3, showing rotational directions via arrows.
Figure 10:
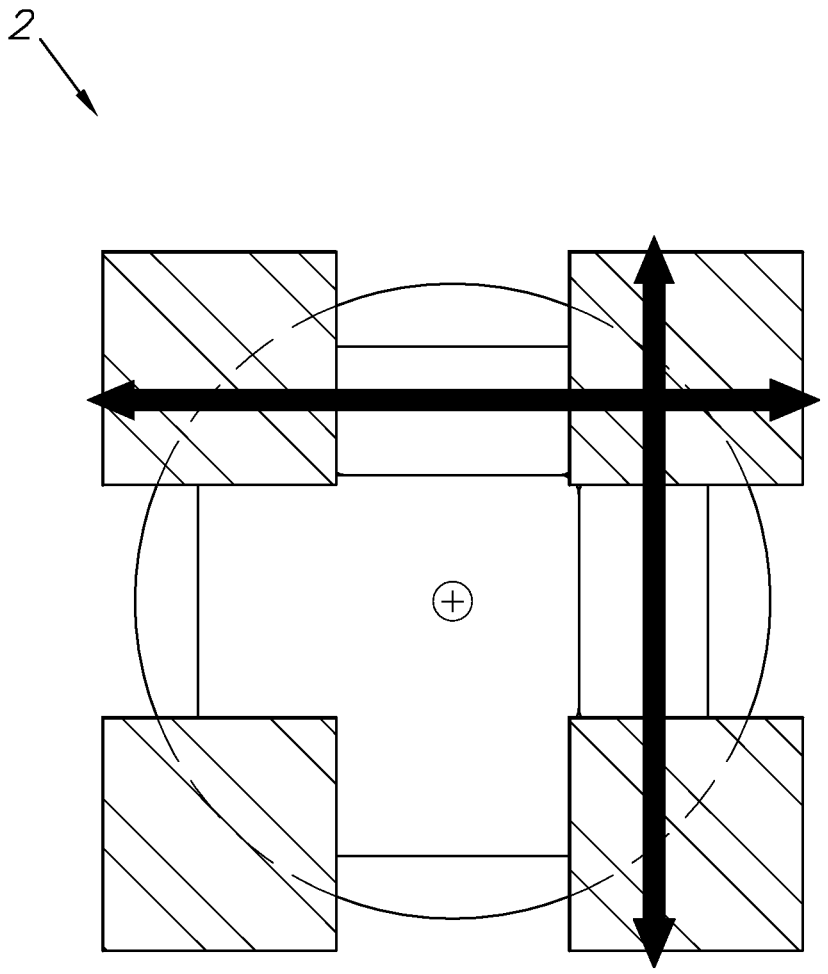
FIG. 10 is a bottom plan view of FIG. 5, showing rotational directions via arrows.
Figure 11:
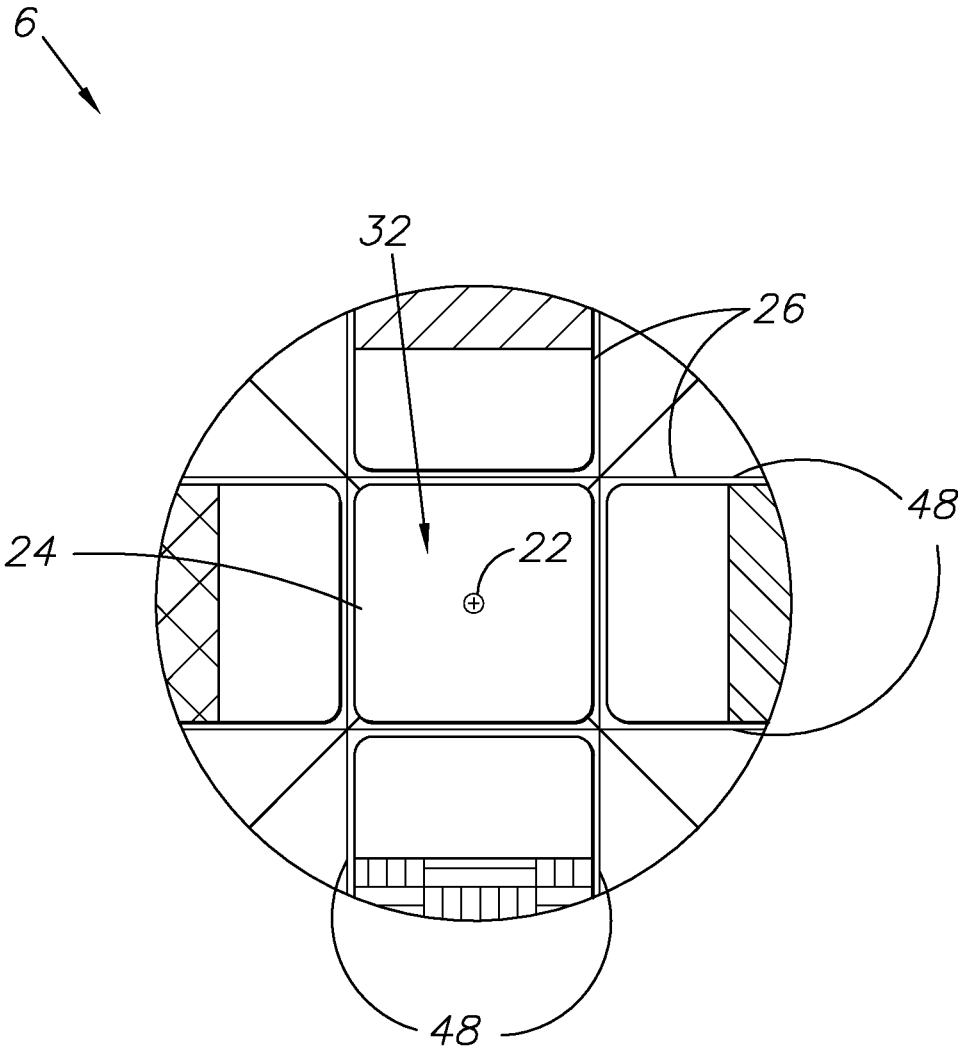
FIG. 11 is a top plan view of a sphere element of the preferred embodiment thereof.
Figure 12:
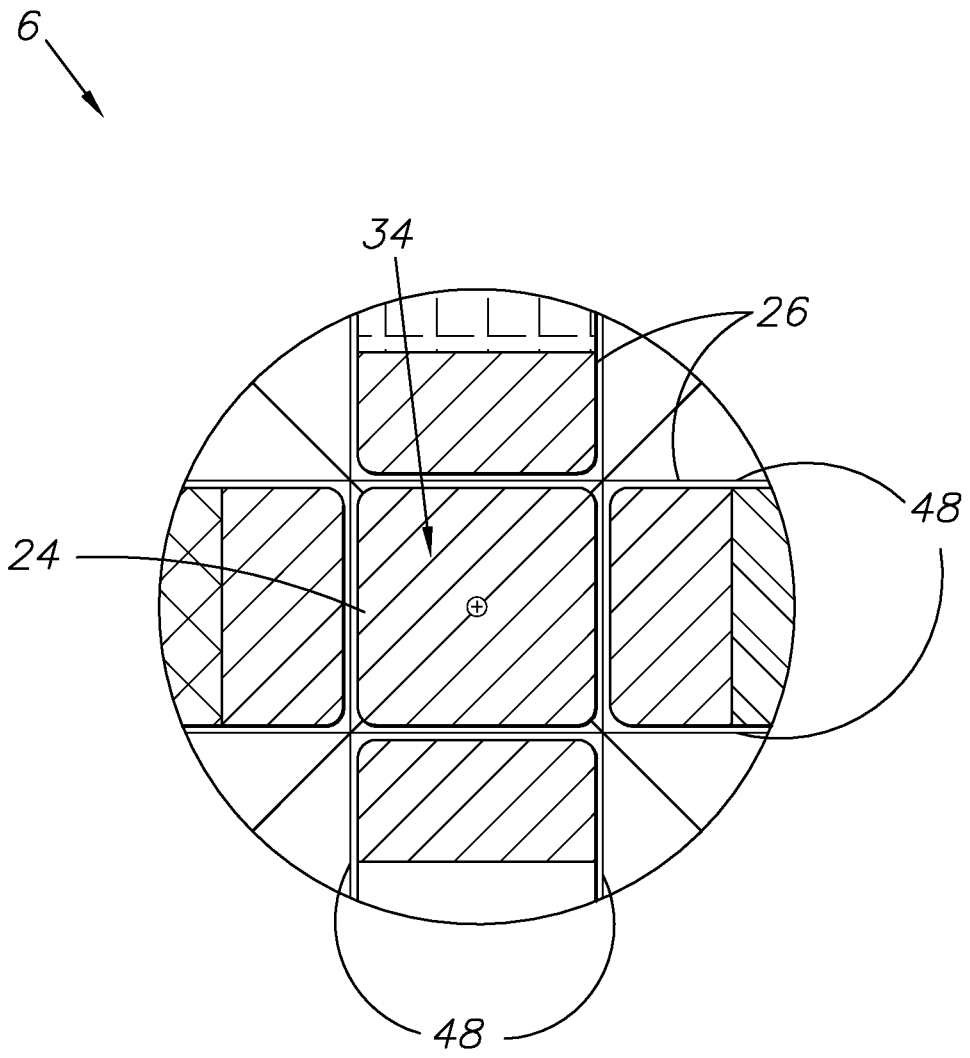
FIG. 12 is a rear side elevational view of a sphere element thereof.
Figure 13:
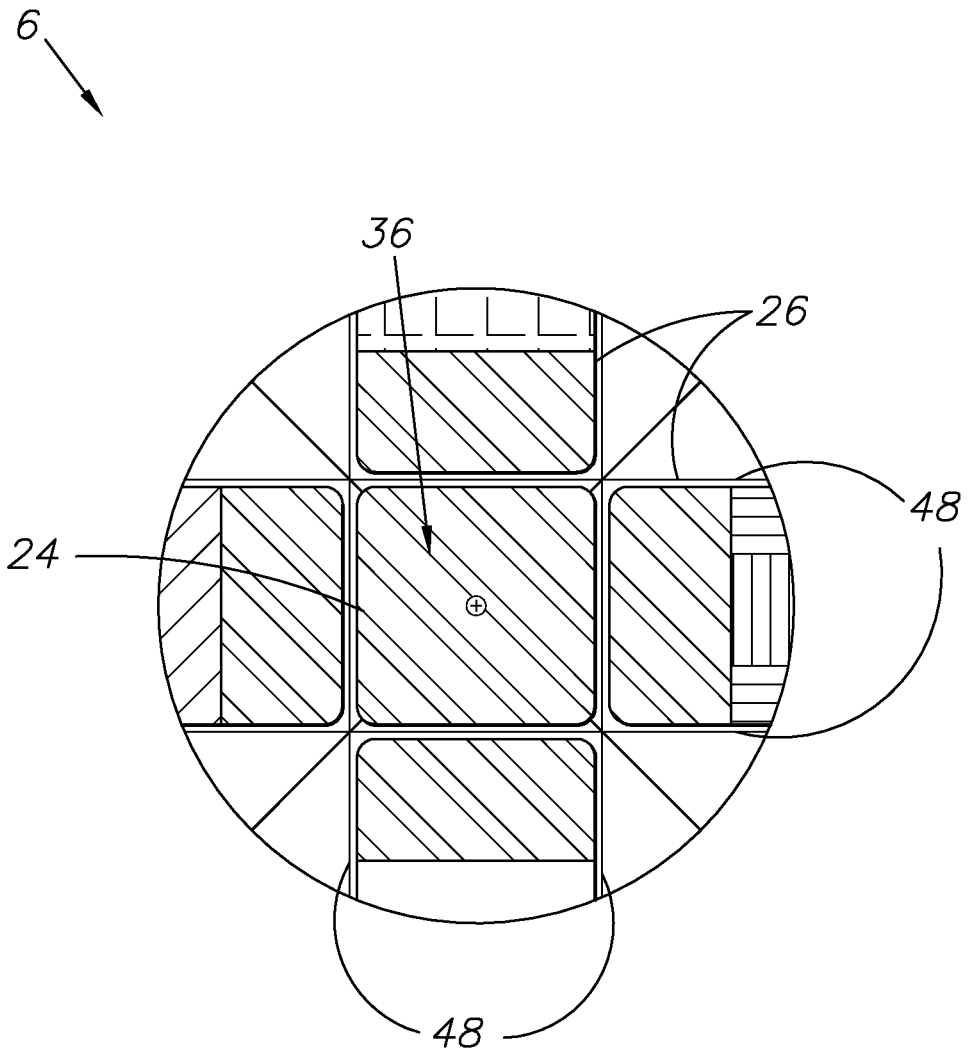
FIG. 13 is a bottom plan view of a sphere element thereof.
Figure 14:
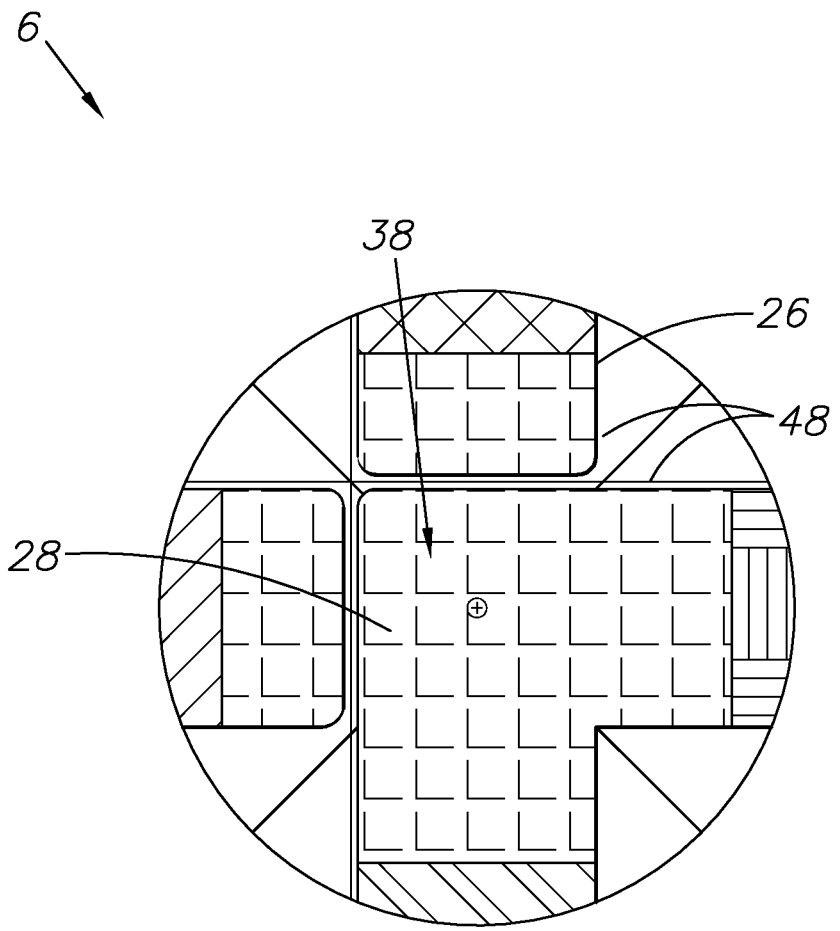
FIG. 14 is a right side plan view of a sphere element thereof.
Figure 15:
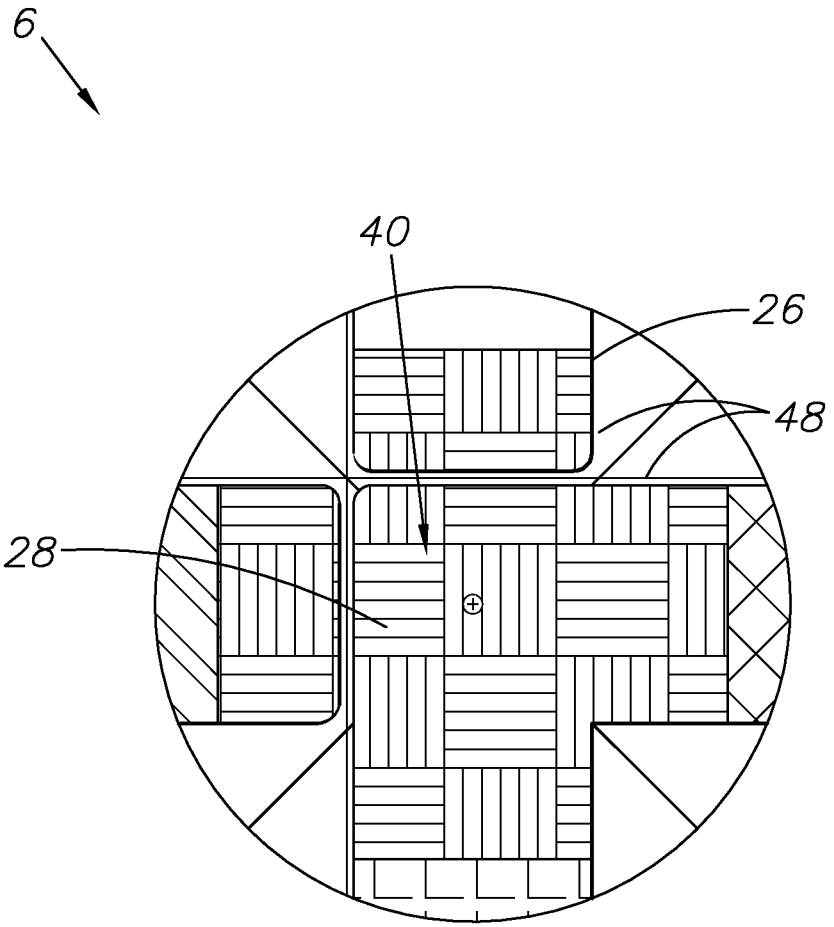
FIG. 15 is a front side elevational of a sphere element view thereof.
Figure 16:
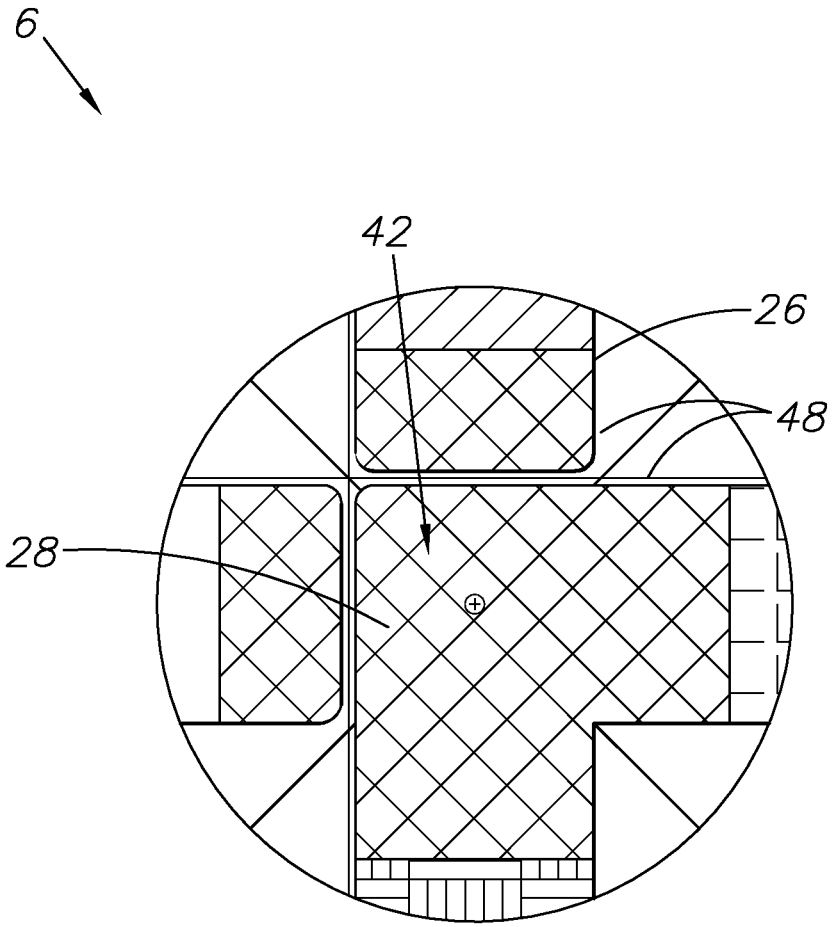
FIG. 16 is a left side elevational of a sphere element view thereof.
Figure 17:
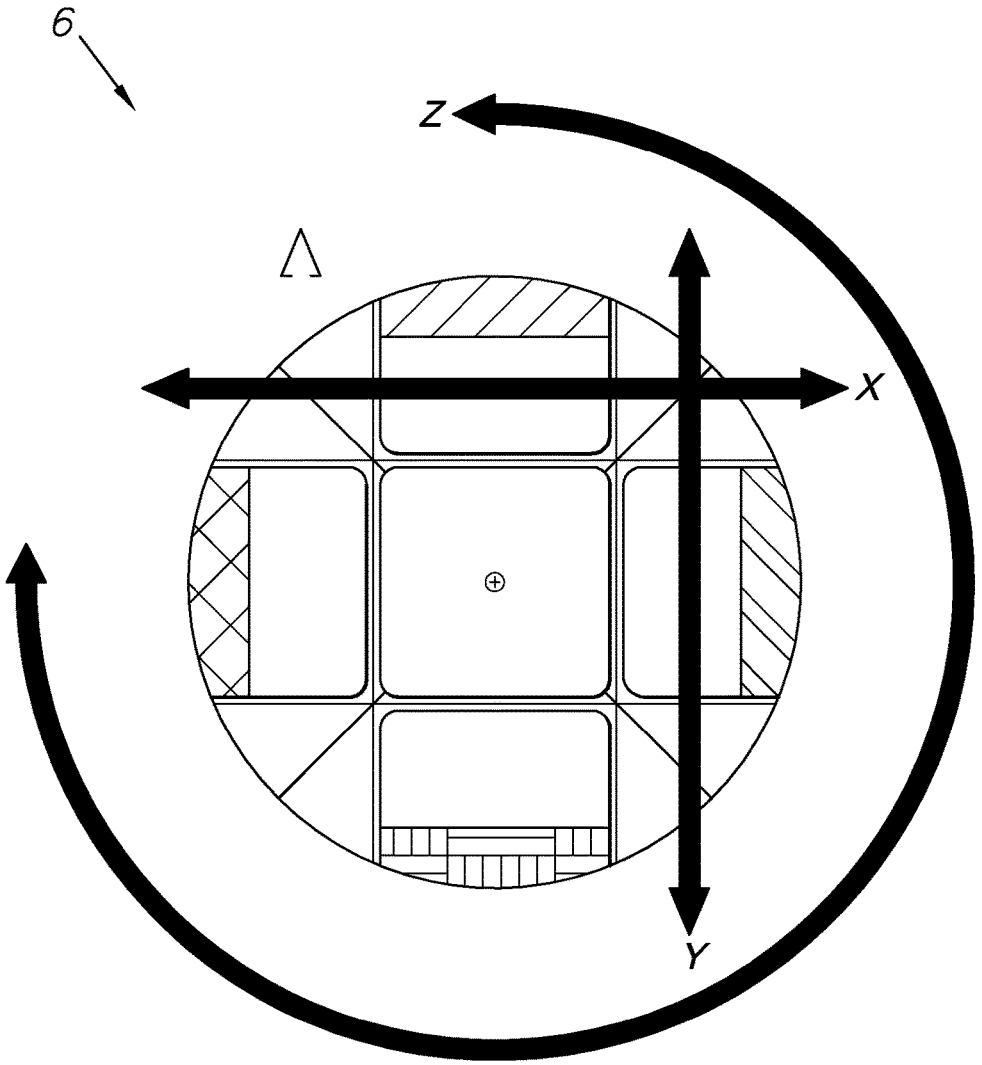
FIG. 17 is the top plan view of FIG. 11, showing rotational directions via arrows.
Figure 18:
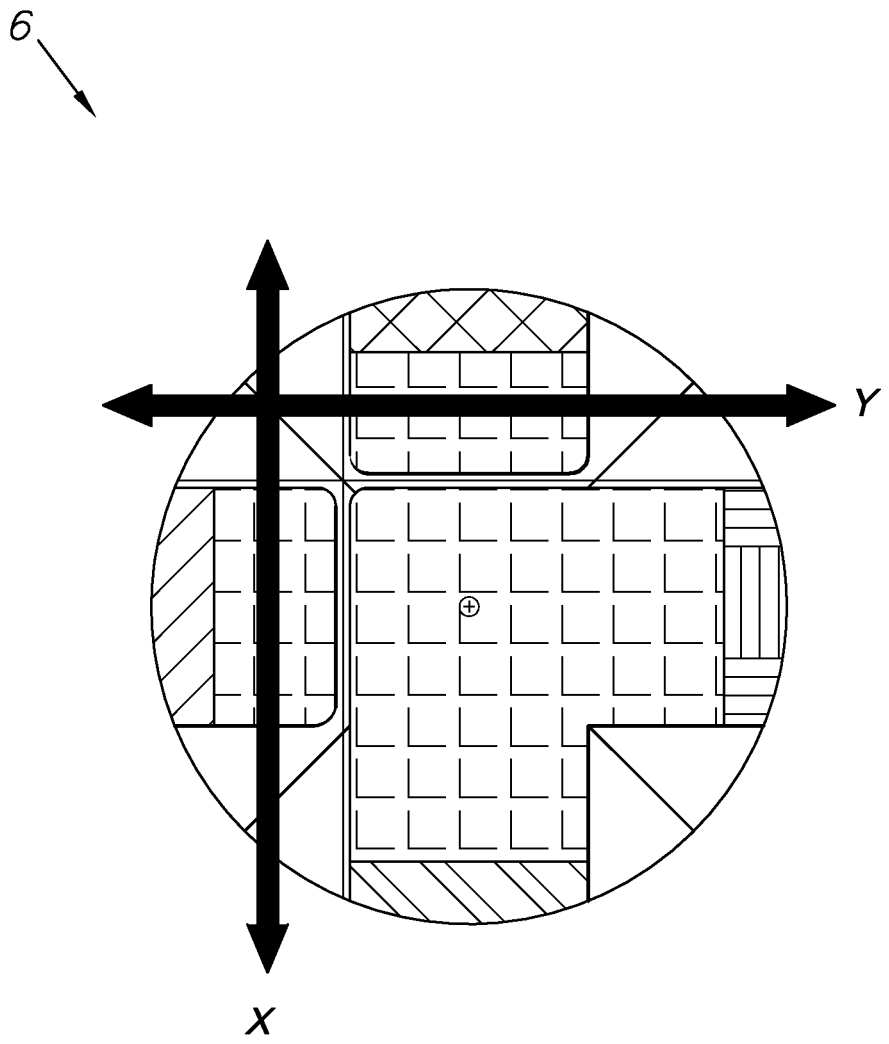
FIG. 18 is a bottom plan view of FIG. 14, showing rotational directions via arrows.

As shown in FIGS. 1-2, the present invention is a puzzle game having an exterior cube puzzle 4 surrounding an interior sphere puzzle 6. The outer cube is made up of six faces 8, 10, 12, 14, 16, 18, each having four panels 20 and where the puzzle is solved when all four panels of each of the six faces are matched as the same color or pattern. Each of the six faces will be of a different color (e.g., yellow, green, blue, red, orange, and white). Alternatively, each face could be a different pattern or have corresponding images.

Similarly, the sphere puzzle 6 has six corresponding "faces" 32, 34, 36, 38, 40, 42. Like the cube puzzle, the sphere puzzle is solved by matching the halves of the floating pieces to the six colored pole pieces of the sphere. Each of the poles will be of a different color, corresponding to a half of four of the floating pieces (e.g., yellow, green, blue, red, orange, and white). Three of the pole pieces 24 allow rotation about all sides of the pieces, allowing the floating side pieces 26 to be matched to it. The other three pole pieces 28 are in a V-shape which prevents rotation of two sides in two directions depending upon where the V-shaped pieces 28 are located, as shown in FIGS. 9-10 and 17-18.

Three axes pass through the puzzle, pinned on six poles of the sphere 6. The floating spherical pieces rotate about these poles, as do the exterior panels of the cube puzzle 4. The cube's 4 faces 8, 10, 12, 14, 16, 18 are formed from eight corners 5, each of which contain three of the panels 20, making four panels per side. The corners 5 are connected to corner slots 44 within the sphere 6 via a connecting piece 46, which forms the interior of each corner 5. The sphere puzzle 6 is viewable through gaps 30 within the cube puzzle 4.

When solving the exterior cube puzzle, the user will simply rotate the cube panels 20 about the axes similar to a Rubik's cube puzzle. The puzzle is solved when all four panels 20 on each corresponding face of the cube match with the same color, e.g., a first face has four blue panels, a second face has four red panels, a third face has four orange panels, a fourth face has four yellow panels, a fifth face has four green panels, and a sixth face has four white panels. FIGS. 3-8 show these various configurations.

When solving the interior sphere puzzle 6, the user will similarly rotate the cube panels 20 about the axes, which will in turn rotate the floating pieces within the sphere puzzle 6. The spherical puzzle movement is asymmetric by design, wherein three of the pieces, the V-shaped pieces 28, are fused to three of the poles. The sphere has same six matching colors as the outer cube. The puzzle is solved when all six poles are surrounded by four matched color halves of the floating pieces, e.g., a first yellow-colored pole is surrounded by four yellow-colored halves of four floating pieces, a second green-colored pole is surround by four green-colored halves of four floating pieces, a third orange-colored pole is surrounded by four orange-colored halves of four floating pieces, a fourth red-colored pole is surrounded by four red-colored halves of four floating pieces, a fifth blue-colored pole is surrounded by four blue-colored halves of four floating pieces, and a sixth white-colored pole is surrounded by four white-colored halves of four floating pieces. FIGS. 11-16 show these configurations. The three V-shaped pieces 28 include a central core and affixed two side pieces, whereas the other two sides are matched by the floating side pieces 26.

The poles connecting the six faces of the sphere are connected forming three axes. The poles can be formed using an internal core connected to via screws 22 as shown, or could be some other connection element such as an internal connection not requiring screws or other externally joining elements. The poles could be a six-pronged central core, which follows the three axes X, Y, and Z.

III. Method of Solving Puzzle Game 2

There are several moves to solving the puzzle game 2. It is the unique geometry of the puzzle that gives uniqueness to the present invention, rather than the particular colors or patterns. No two pieces identical color sets or shapes. If the colors are the same then the sizes of the pieces may be altered to make the puzzle solvable by shape alone.

As shown above, the inner sphere includes six poles of different colors or patterns. There are nine moveable side spherical shapes 26 each with two different colors or patterns on each. There are three fixed single-color pole portions 24 and three half-side spherical V-shapes 28.

The outer cube includes eight tricolored cube corners 5 each with three panels. The shapes could vary from the cube shape as shown.

Puzzle movement is achieved by rotating the outer cube 4. The outer cube is connected to the inner sphere 6 such that the inner sphere portions are rotated as the outer cube rotates. The puzzle rotates along the rotation planes 48 as indicated in FIGS. 11-16. The inner sphere 6 cannot be rotated without also rotating the outer cube 4. A combination of moves can be used to solve the puzzle.

Correct location and orientation is required for every piece of the puzzle to be solved. Location is correct when all of the colors of a moveable piece match with all of the other pieces it is touching or is on the same face as it is. Orientation may be wrong, even if location is correct. If all of the colors are correct based upon their respective adjacent pieces, but the piece is simply turned onto the wrong face or side, an orientation needs to be adjusted.

The key to the puzzle are the V-shaped pieces 28 of the sphere puzzle 6. The user should look for the pole that includes only two spherical side shapes next to it, forming the V-shaped portion 28. The user places the chosen V-shaped piece toward the top as the puzzle is oriented, typically with one of the three sides of the sphere 6 or cube 4 being a chosen color to solve.

The user makes the top a dome of a single color where the side spherical pieces of the side sphere pieces 26 match the pole piece that the user has selected. The pole piece could be a V-shaped piece 28 or a fixed pole piece 24. The side spherical pieces match around the pole at each of the ninety degree placement next to the chosen pole.

The user can solve the sphere puzzle 6 alone, ignoring the cube puzzle 4. Alternatively, the user can solve the cube puzzle 4 alone, ignoring the sphere puzzle 6. However, the puzzle 2 is designed ultimately to solve both the cube puzzle 4 and sphere puzzle 6 at the same time, such that first cube side 10 matches the first sphere side 32, the second cube side 12 matches the second sphere side 34, the third cube side 14 matches the third sphere side 36, the fourth cube side 16 matches the fourth sphere side 38, the fifth cube side 18 matches the fifth sphere side 40, and the sixth cube side 20 matches the sixth sphere side 42.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A game system comprising:

a cube puzzle portion comprising eight corner elements each comprising three panels;

an internal puzzle portion comprising fifteen components;

said internal puzzle portion having eight corner slots, each configured for receiving one of each of said eight corner elements of said cube puzzle portion;

said cube puzzle portion configured to rotate about three axes, thereby also rotating said internal puzzle portion;

said cube puzzle portion comprising six faces formed by said panels;

said internal puzzle portion comprising six faces formed by said fifteen components;

said fifteen components including three V-shaped components;

said fifteen components including three pole components;

said fifteen components including nine floating side pieces each of said three pole components comprising a respective one of three colors selected from six colors;

each of said three V-shaped components comprising a respective one of three colors selected from said six colors, whereby said V-shaped components respective three colors differ from said pole component three colors;

each of said nine floating side pieces comprising two of said six colors; and whereby a solution to the game system is comprised by rotating said panels and said fifteen components, thereby matching said panels and said components according to their respective faces.

2. The game system of claim 1, further comprising:

a core located within said internal puzzle portion;

said core comprising three axes; and whereby said three pole components and said three V-shaped components are rotatably mounted to said core, allowing rotation about said three axes.

3. The game system of claim 2, wherein said V-shaped components restrict rotation of said internal puzzle portion and said cube puzzle portion along at least one axis.

4. The game system of claim 1, further comprising:

each of said panels comprising one of six colors; and whereby said solution comprises aligning said panels such that each of said cube puzzle portion's six faces includes four panels of the same one of said six colors.

5. The game system of claim 1, further comprising:

each of said panels comprising one of six colors; and whereby said solution comprises aligning said panels such that each of said cube puzzle portion's six faces includes four panels of the same one of said six colors.

6. The game system of claim 1, wherein said internal puzzle portion comprises a sphere shape.

7. A method of solving a puzzle game, the method comprising the steps:

rotating a cube puzzle portion of the puzzle game, said cube puzzle portion comprising eight corner elements each comprising three panels;

rotating a sphere puzzle portion by rotating said cube puzzle portion, said sphere puzzle portion comprising fifteen components, eight corner slots, each configured for receiving one of each of said eight corner elements of said cube puzzle portion;

aligning said cube puzzle portion comprising six faces formed by said panels;

aligning said sphere puzzle portion comprising six faces formed by said fifteen components;

said fifteen components including three V-shaped components;

said fifteen components including three pole components;

said fifteen components including nine floating side pieces;

each of said three pole components comprising a respective one of three colors selected from six colors;

each of said three V-shaped components comprising a respective one of three colors selected from said six colors, whereby said V-shaped components respective three colors differ from said pole component three colors;

each of said nine floating side pieces comprising two of said six colors; and reaching a solution to the game by matching said panels and said components according to their respective faces.

8. The method of claim 7, further comprising:

a core located within said sphere puzzle portion;

said core comprising three axes; and whereby said three pole components and said three V-shaped components are rotatably mounted to said core, allowing rotation about said three axes.

9. The method of claim 8, wherein said V-shaped components restrict rotation of said sphere puzzle portion and said cube puzzle portion along at least one axis.

10. The method of claim 7, further comprising:

each of said panels comprising one of six colors; and whereby said solution comprises aligning said panels such that each of said cube puzzle portion's six faces includes four panels of the same one of said six colors.

11. The method of claim 7, further comprising:

each of said panels comprising one of six colors; and whereby said solution comprises aligning said panels such that each of said cube puzzle portion's six faces includes four panels of the same one of said six colors.

* * * * *